United States Patent [19]

Plasko

[11] 3,992,771

[45] Nov. 23, 1976

[54] METHOD OF MAKING THERMAL LIMITER CONSTRUCTION

[75] Inventor: Emil Robert Plasko, Washington Township, Ohio

[73] Assignee: Emerson Electric Co., St. Louis, Mo.

[22] Filed: Sept. 22, 1975

[21] Appl. No.: 615,790

Related U.S. Application Data

[62] Division of Ser. No. 472,413, May 22, 1974, Pat. No. 3,924,218.

[52] U.S. Cl. ..... 29/623

[51] Int. Cl.[2] ..... H01H 69/02

[58] Field of Search ..... 29/623; 337/403, 404, 337/405, 407, 408, 409

[56] References Cited

UNITED STATES PATENTS

| | | | |
|---|---|---|---|
| 3,624,899 | 12/1971 | Smith, Jr. | 29/623 |
| 3,727,164 | 4/1973 | Cartier et al. | 337/409 X |
| 3,821,685 | 6/1974 | Kimball et al. | 337/409 |
| 3,875,546 | 4/1975 | Merrill | 337/408 X |
| 3,944,960 | 3/1976 | Audette et al. | 337/409 X |

*Primary Examiner*—Victor A. DiPalma
*Attorney, Agent, or Firm*—Candor, Candor & Tassone

[57] ABSTRACT

A thermal limiter construction having a casing provided with an insulating end plug carrying a conductor with an enlarged contact head inside said casing and against which spring controlled sliding contact means in the casing normally engages to conductively interconnect the casing and the conductor together. A washer-like member is telescopically disposed about the contact head and is disposed between the sliding contact means and a spring that acts between the sliding contact means and the end plug to tend to move the sliding contact means away from the contact head whereby the washer-like member separates the spring from the sliding contact means. Such sliding contact means can comprise a plurality of conductive balls disposed in a circular array in the casing.

5 Claims, 8 Drawing Figures

METHOD OF MAKING THERMAL LIMITER CONSTRUCTION

This is a division of application Ser. No. 472,413 filed May 22, 1974, now U.S. Pat. No. 3,924,218.

This invention relates to an improved thermal limiter construction and to a method of making the same or the like.

It is well known that thermal limiter constructions have been provided wherein each has a casing provided with an insulating end plug carrying a conductor with an enlarged contact head inside the casing and against which spring controlled sliding contact means in the casing normally engages to conductively interconnect the casing and the conductor together, the sliding contact means being held in such contact condition by spring means disposed between the sliding contact means and a pellet which will melt when the same reaches a certain temperature to thereby cause another spring disposed between the sliding contact means and the end plug to move the sliding contact means out of contact with the conductor head to thereby open the circuit between said conductor and the casing of the thermal limiter construction.

For example, see the U.S. patents to Merrill, U.S. Pat. Nos. 3,180,958 and 3,519,972 which fully describe and claim such thermal limiter construction.

The U.S. patent to Henry, U.S. Pat. No. 3,781,737, discloses the use of a plurality of conductive balls disposed in a circular array as the sliding contact means for such a thermal limiter construction but requires the internal contact head to be modified by requiring an elongated extension to be provided on the arresting head of the internal conductor with the extension contacting the conductive balls.

It has been found according to the teachings of this invention that such extension of the aforementioned patent to Henry can be eliminated and the conductor of the aforementioned patent to Merrill, U.S. Pat. No. 3,519,972, can be utilized in combination with the circular array of conductive balls when a washer-like member is telescopically disposed about the contact head of the conductor and is disposed between the conductive balls and the spring that normally tends to move the conductive balls out of engagement with the internal conductor. In this manner, the washer-like member will move the balls in unison away from the contact head when the limiter blows so that short circuiting between one of the balls and the contact head cannot take place.

Accordingly, it is a feature of this invention to provide an improved thermal limiter construction utilizing a washer-like member between the sliding contact means and the spring that normally tends to move the sliding contact means out of contact with the internal conductor of the thermal limiter construction.

Another feature of this invention is to provide an improved method of making such a thermal limiter construction or the like.

In particular, one embodiment of this invention provides a thermal limiter construction having a casing provided with an insulating end plug carrying a conductor with an enlarged contact head inside the casing and against which spring controlled sliding contact means in the casing normally engages to conductively interconnect the casing and the conductor together. A washer-like member is telescopically disposed about the contact head and is disposed between the sliding contact means and a spring that acts between the sliding contact means and the end plug to tend to move the sliding contact means away from the contact head whereby the washer-like member separates the spring from the sliding contact means. The sliding contact means can comprise a plurality of conductive balls disposed in a circular array in the casing of the thermal limiter construction.

Accordingly, it is an object of this invention to provide an improved thermal limiter construction having one or more of the novel features set forth above or hereinafter shown or described.

Another object of this invention is to provide an improved method of making such a thermal limiter construction or the like.

Other objects, uses and advantages of this invention are apparent from a reading of this description which proceeds with reference to the accompanying drawings forming a part thereof and wherein.

Figure 1:
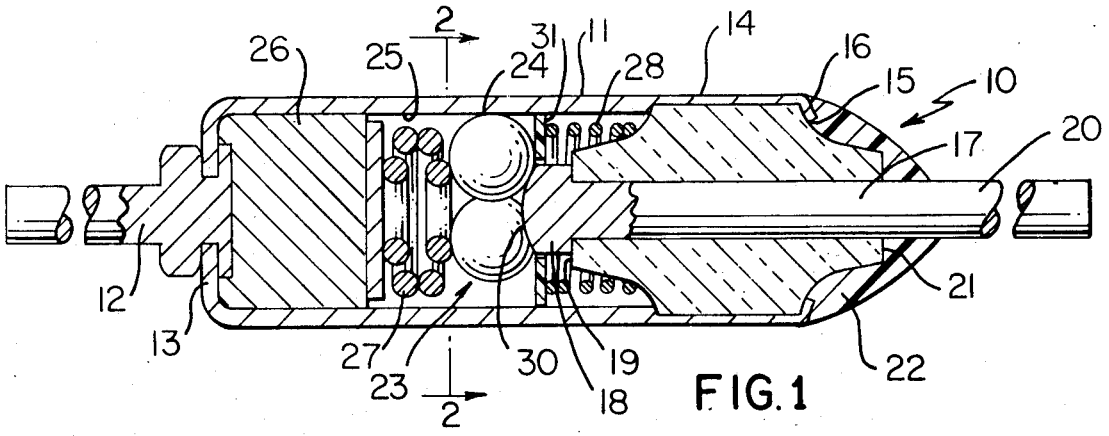
FIG. 1 is a cross-sectional view illustrating the improved thermal limiter construction of this invention.

While the various features of this invention are hereinafter described and illustrated in connection with a thermal limiter construction that opens the electrical circuit therebetween when a certain temperature is reached, it is to be understood that the various features of this invention can be utilized singly or in any combination thereof to provide a thermal limiter construction that will operate in any desired manner.

Therefore, this invention is not to be limited to only the embodiment illustrated in the drawings, because the drawings are merely utilized to illustrate one of the wide variety of uses of this invention.

Figure 3:
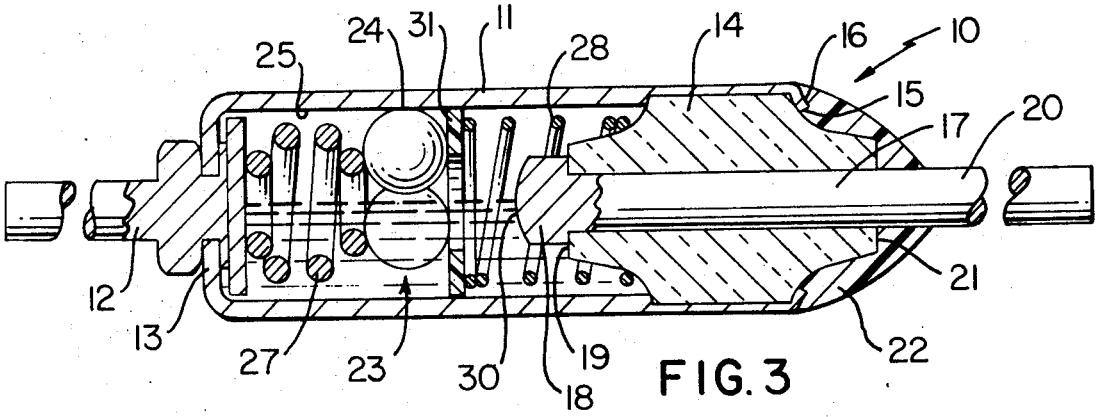
FIG. 3 is a view similar to FIG. 1 and illustrates the thermal limiter construction in an open condition thereof.
Figure 8:
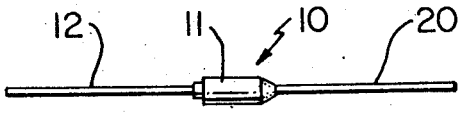
FIG. 8 is a side view of the thermal limiter construction of FIG. 1 in a reduced size and substantially illustrating the actual size of a thermal limiter construction incorporating the features of this invention.
Figure 2:
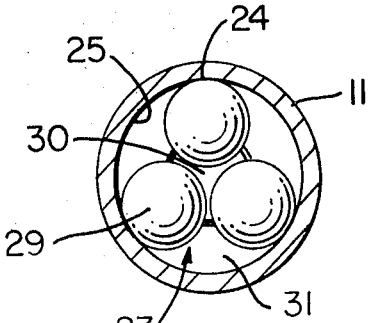
FIG. 2 is a cross-sectional view taken on line 2—2 of FIG. 1.

Referring now to FIGS. 1, 2 and 3, the improved thermal limiter construction of this invention is generally indicated by the reference numeral 10 and is substantially similar to the thermal limiter construction disclosed and claimed in the aforementioned U.S. patent to Merrill, U.S. Pat. No. 3,519,972, whereby such patent is incorporated in this disclosure by reference thereto as any information desired as to the particular construction and operation of the thermal limiter construction 10 can be obtained from such patent.

Therefore, it is believed only necessary to describe the thermal limiter construction 10 in a general manner hereinafter in order to understand the improved features of this invention.

Figure 7:
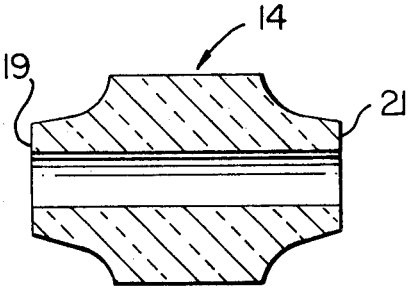
FIG. 7 is a cross-sectional view of the insulating end plug of the thermal limiter construction of FIG. 1.

In particular, the thermal limiter construction 10 includes a conductive casing 11 having a conductor 12 secured in electrical contact with the closed end 13 of the casing 11. A ceramic end plug 14, as best illustrated in FIG. 7, is disposed in an open end 15 of the casing and is secured thereto by a turned over portion 16 of the end 15 of the casing 11 as illustrated in FIG. 1, a second electrical conductor 17 passing through the bushing or end plug 14 and having an enlarged contact head 18 disposed against one end 19 of the end plug 14 and having the other end 20 thereof projecting out of the other end 21 of the end plug 14 for external lead attachment purposes.

As fully described in the aforementioned U.S. patent to Merrill, U.S. Pat. No. 3,519,972, the end plug 14 can be assembled in the end 15 of the casing 11 with either the end 19 or end 21 projecting into the casing 11 as the end plug 14 is reversible with the end 19 or 21 performing the same function as the other end 21 or 19 depending upon the position of the end plug 14 in the casing 11.

For example, the end 19 of the end plug 14 supports the contact head 18 at a particular position in the casing 11 and prevents the conductor 17 from moving to the right in FIG. 1 as the enlarged head 18 is arrested against the end 19 of the end plug 14.

The other end 21 of the end plug 14 permits an epoxy seal 22 to be disposed on the end 15 of the casing 11 and extend down the end plug 14 onto the conductor end 20 to seal the open end 15 of the casing 11 from the atmosphere while at the same time insuring that a sufficient air gap exists between the exposed part of the end 20 of the conductor 17 and the casing 11 at the end 15 to prevent shorting therebetween as will be apparent hereinafter.

A sliding contact means that is generally indicated by the reference numeral 23 in the drawings is disposed inside the casing 11 and has its outer peripheral means 24 disposed in sliding engagement with the internal surface 25 of the casing 11 to provide electrical contact therebetween.

A thermally responsive pellet 26, of the type set forth in the aforementioned patents to Merrill or formed of other suitable material, is disposed in the casing 11 against the end wall 13 thereof and a pair of compression springs 27 and 28 are respectively disposed on opposite sides of the sliding contact means 23 such that the compression spring 27 is in a compressed condition between the solid pellet 26 and the sliding contact means 23 and is stronger in its compressed condition than the force of the compressed spring 28 which is disposed between the sliding contact means 23 and the end plug 14 whereby the sliding contact means 23 is held by the force of the spring 27 in electrical contact with the enlarged contact head 18 of the conductor 17 so that an electrical circuit can be provided between the conductors 12 and 17 through the casing 11 and sliding contact means 23 of the thermal limiter construction 10 as illustrated in FIG. 1.

However, when the particular temperature for melting the pellet 26 is reached, the pellet 26 will melt in the manner illustrated in FIG. 3 whereby the springs 27 and 28 are adapted to expand and thereby through the relationship of the particular forces of the expanded springs 27 and 28, the sliding contact means 23 is moved out of electrical contact with the contact head 18 of the second conductor 17 in the manner illustrated in FIG. 3 so that the electrical circuit between the conductors 12 and 17 through the thermal limiter construction 10 is broken and remains open as illustrated in FIG. 3 until the thus blown thermal limiter construction 10 is replaced.

Figure 4:
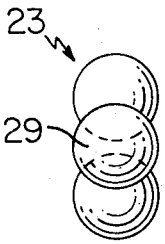
FIG. 4 is a side view of the sliding contact means of the thermal limiter construction of FIG. 1.

As previously stated, the sliding contact means 23 of the thermal limiter construction 10 of this invention comprises a plurality of conductive metal balls 29 disposed in a circular array as illustrated in FIG. 4 inside the casing 11 and are all normally urged into electrical contact with the enlarged contact head 18 of the conductor 17 by the compression spring 27. By having the enlarged head 18 of the conductor 17 provided with a convex end surface 30, the resultant force of the balls 29 being urged against the convex end surface 30 of the conductive head 18 by the compression spring 27 is to wedge the balls 29 all outwardly so as to be placed into intimate contact with the internal peripheral surface 25 of the conductive casing 11 in much the same manner as provided by the resilient fingers of the sliding contact member of the aforementioned patents to Merrill whereby the particular end connector 17 of the U.S. patent to Merrill U.S. Pat. No. 3,519,972, can be utilized for a thermal limiter construction 10 of this invention wherein the conductive balls 29 are utilized as a sliding contact means 23 thereof as well as for the thermal limiter construction of the aforementioned patent to Merrill wherein the sliding contact member comprises a single disc-like member having resilient peripheral fingers resiliently urged into intimate contact with the internal peripheral surface of the conductive casing.

Thus, it can be seen that the elongated extension provided in the aforementioned patent to Henry, U.S. Pat. No. 3,781,737, can be eliminated as the enlarged head 18 of the conductor 17 of this invention provides the dual function of providing an arresting head against the end 19 of the bushing 14 to prevent the connector 17 from passing out of the same to the right under the force of the compression spring 27 and also provides a contact head against which the conductive balls 29 are placed in electrical contact by the force of the compression spring 27. The convex surface 30 of the head 18 of the conductor 17 in combination with the force of the compressed spring 27 acting on the balls 29 insures that balls 29 will have their outer peripheries 24 urged resiliently into intimate contact with the internal peripheral surface 25 of the casing 11 for good electrical contact therebetween.

Figure 5:
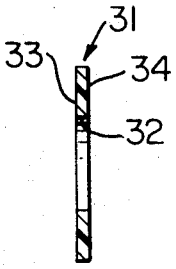
FIG. 5 is a cross-sectional view of a washer-like member of the thermal limiter construction of FIG. 1.
Figure 6:
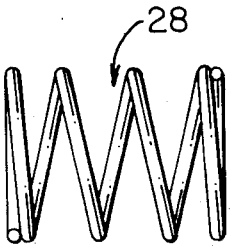
FIG. 6 is a side view of a spring of the thermal limiter construction of FIG. 1.

A washer-like member of this invention that is generally indicated by the reference numeral 31 in FIG. 5 can be formed of insulating material and have a central bore 32 passing through opposed flat sides 33 and 34 thereof so as to be adapted to be disposed in loose telescopic relation about the enlarged head 18 of the conductor 17 as illustrated in FIG. 1. Thus, the washer-like member 31 can be disposed between the conductive balls 29 and the compression spring 28 to separate the compression spring 28 from the conductive balls 29.

In this manner, it is believed that the washer-like member 31 will uniformly transmit the force of the expanding compression spring 28 to all of the conductive balls 29 when the same are being moved away from the head 18 of the conductor 17 by the expanding spring 28 when the pellet 26 melts as illustrated in FIG. 3 so that the likelihood of any shorting between any of the balls 29 and the head 18 will be prevented by the washer-like member 31 uniformly moving the balls 29 away from the head 18 of the conductor 17 when the thermal limiter construction 10 is performing its circuit opening function.

Therefore, it can be seen that the washer-like member 31 operates to move the balls 29 in substantial unison away from the conductive head 18 of the conductor 17 under the force of the expanding compression spring 28 when the pellet 26 melts and holds the same away from the conductor head 18 in the manner illustrated in FIG. 3 while separating the spring 28 from the balls 29.

In this manner, it can be seen that the conductor head 18 can perform the dual function of a contact head and an arresting head while the conductive balls 29, when disposed in engagement against the same, are wedged resiliently outwardly into intimate electrical contact with the internal peripheral surface 25 of the casing 11 by the spring 27 so that the conductor 17 need not have an extension thereon for contact with the balls 29 as provided in the aforementioned patent to Henry, U.S. Pat. No. 3,781,737.

If desired, another washer-like member (not shown), similar to the washer-like member 31, disc, or separator of any suitable material can be disposed between the spring 27 and the balls 29 to separate the same from each other even though the spring 27 and balls 29 will still function in the manner previously described.

In view of the above, it can be seen that this invention not only provides an improved thermal limiter construction, but also this invention provides an improved method of making such a thermal limiter construction.

While the form and method of this invention now preferred have been described and illustrated as required by the Patent Statute, it is to be understood that other forms and method steps can be utilized and still come within the scope of the appended claims.

I claim:

1. In a method of making a thermal limiter construction having a casing provided with an end plug carrying a conductor with an enlarged contact head inside said casing and against which spring controlled sliding contact means in said casing normally engages to conductively interconnect said casing and said conductor together, the improvement comprising the step of disposing a washer-like member in telescopic relation about said contact head and between said sliding contact means and a spring that acts between said sliding contact means and said end plug to tend to move said sliding contact means away from said contact head whereby said washer-like member separates said spring from said sliding contact means.

2. A method of making a thermal limiter construction as set forth in claim 1, and including the step of forming said sliding contact means from a plurality of conductive balls disposed in a circular array in said casing.

3. A method of making a thermal limiter construction as set forth in claim 2, and including the step of forming said washer-like member from a non-conductive material.

4. A method of making a thermal limiter construction as set forth in claim 2, and including the step of forming said enlarged contact head with a convex surface that is engaged by said balls to wedge the same outwardly into contact with said casing.

5. A method of making a thermal limiter construction as set forth in claim 4, and including the step of engaging said enlarged contact head of said conductor against said end plug to arrest movement of said conductor out of said casing.

* * * * *